US008055167B2

(12) United States Patent
Park et al.

(10) Patent No.: US 8,055,167 B2
(45) Date of Patent: Nov. 8, 2011

(54) IMAGE FORMING APPARATUS INCLUDING PRESSING UNIT TO MAINTAIN GAP BETWEEN ROLLERS

(75) Inventors: Gyeong Ho Park, Suwon-Si (KR); Won Choe, Yongin-Si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 523 days.

(21) Appl. No.: 12/211,428

(22) Filed: Sep. 16, 2008

(65) Prior Publication Data

US 2009/0185835 A1 Jul. 23, 2009

(30) Foreign Application Priority Data

Jan. 21, 2008 (KR) ..... 10-2008-0006054

(51) Int. Cl.
*G03G 15/00* (2006.01)
*G03G 15/04* (2006.01)
*G03G 15/08* (2006.01)

(52) U.S. Cl. ..... 399/267; 399/117; 399/119; 399/258; 399/281; 399/286

(58) Field of Classification Search ..... 399/117, 399/119, 258, 260, 267, 272, 281, 282, 286
See application file for complete search history.

(56) References Cited

U.S. PATENT DOCUMENTS 5,739,900 A * 4/1998 Isobe ..... 355/109

FOREIGN PATENT DOCUMENTS

JP 2005-107222 4/2005

OTHER PUBLICATIONS

English language abstract of JP 2005-107222, published Apr. 21, 2005.
Machine English language translation of JP 2005-107222, published Apr. 21, 2005.

* cited by examiner

*Primary Examiner* — David Gray
*Assistant Examiner* — Joseph Wong
(74) *Attorney, Agent, or Firm* — Stanzione & Kim, LLP

(57) ABSTRACT

An image forming apparatus is disclosed. The image forming apparatus includes a photosensitive body, a magnetic roller disposed at a predetermined distance from the photosensitive body, and a donor roller disposed between the photosensitive body and the magnetic roller. The donor roller has a diameter larger than the closest distance between the photosensitive body and the magnetic roller. The image forming apparatus includes gap rings and pressing device to maintain desired gaps between the magnetic roller and the donor roller and between the donor roller and the photosensitive body.

26 Claims, 8 Drawing Sheets

IMAGE FORMING APPARATUS INCLUDING PRESSING UNIT TO MAINTAIN GAP BETWEEN ROLLERS

CROSS-REFERENCE TO RELATED APPLICATION

This application claims the benefit of Korean Patent Application No. 2008-0006054, filed on Jan. 21, 2008 in the Korean Intellectual Property Office, the disclosure of which is incorporated herein by reference.

BACKGROUND OF THE INVENTION

1. Field of the Invention

The present invention relates to an image forming apparatus, and more particularly, to an image forming apparatus capable of maintaining a gap between a donor roller and a magnetic roller and a gap between a donor roller and a photosensitive body to a predetermined gap.

2. Description of the Related Art

An image forming apparatus refers to an apparatus, in which an electrostatic latent image corresponding to a desired image is formed on a photosensitive body by an exposure unit, such as, e.g., a laser scanning unit. The electrostatic latent image is developed into a visible image by the use of developer, and the visible image is transferred and fused onto a printing medium. The image forming apparatus includes a developing unit which supplies the developer to the photosensitive body and develops the electrostatic latent image into a visible image.

For example, FIG. 1 illustrates a developing unit generally in use in an image forming apparatus, and FIG. 2 is a perspective view showing the relevant portions of the developing unit depicted in FIG. 1. As shown in FIGS. 1 and 2, a developing unit 200 includes a photosensitive body 220, a magnetic roller 240 to supply a developer to the photosensitive body 220, and a donor roller 230 mounted between the magnetic roller 240 and the photosensitive body 220.

In a one-component developing system, either using an insulating developer or a conductive developer, the donor roller 230 serves to make an image of high quality. In a two-component developing system using a magnetic carrier and a toner, the donor roller 230 serves to prevent the carrier of the magnetic roller 240 from moving to the photosensitive body 220.

To obtain a desired image quality, the developing unit 200 should maintain each of the gap between the donor roller 230 and the photosensitive body 220 (i.e., the developing gap) and the gap between the donor roller 230 and the magnetic roller 240 to be uniform. For example, FIG. 2 illustrates a holding member 281 formed with a pair of through-holes 282 and 283, through which the rotating shaft 231 of the donor roller and the rotating shaft 241 of the magnetic roller are respectively received and supported. This holding member 281 maintains uniform gaps between the donor roller 230 and the magnetic roller 240.

Also provided is an elastic member 285, which elastically supports one side of the holding member 281 and pushes the holding member 281 toward the photosensitive body 220. By the elastic bias imparted by the elastic member 285 on the holding member 281 toward the photosensitive body 220, the gap between the donor roller 230 and the photosensitive body 220 are maintained.

An image forming apparatus with the above described configuration, however, unfortunately, relies on the precisely formed through-holes and/or the rotating shafts to maintain the gaps, and thus often fails to maintain the gaps to the desired preset gaps.

BRIEF DESCRIPTION OF THE DRAWINGS

Various aspects and advantages of the embodiments of the invention will become apparent and more readily appreciated from the following description of the embodiments, taken in conjunction with the accompanying drawings, of which.

DETAILED DESCRIPTION OF THE PREFERRED EMBODIMENTS

Figure 1:
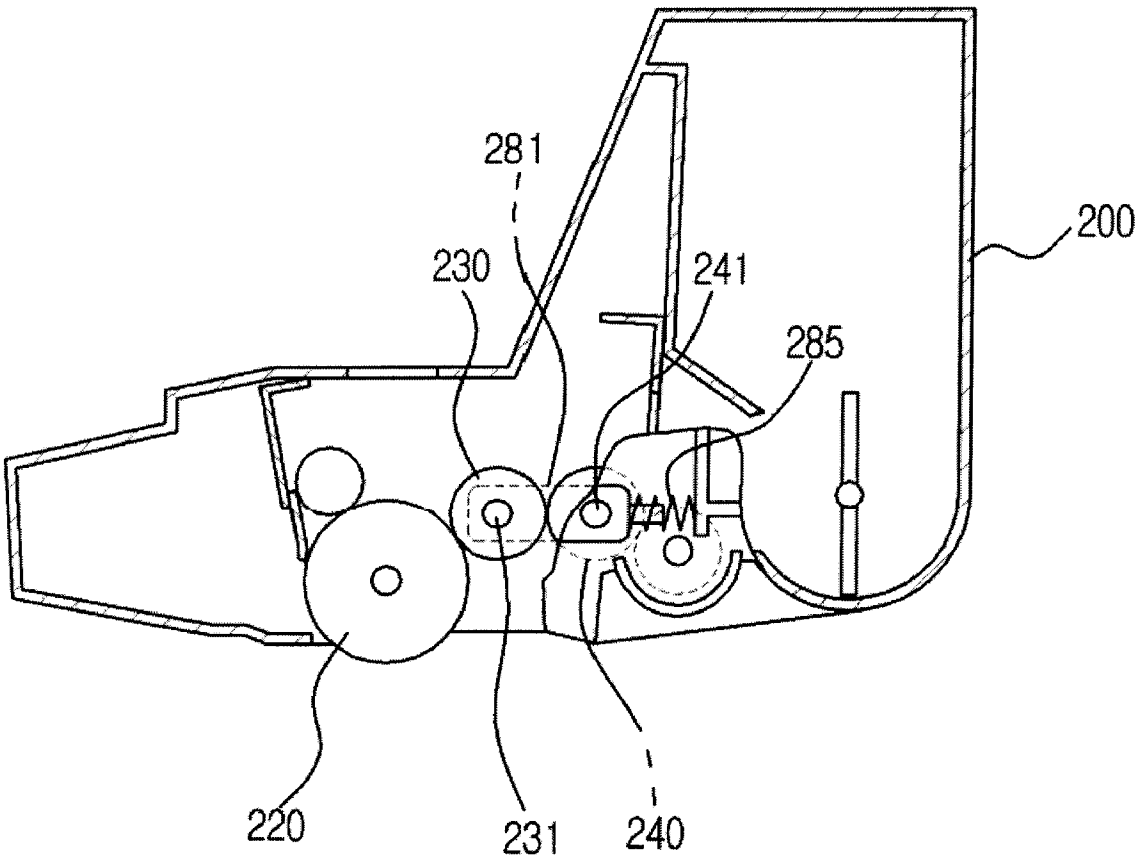
FIG. 1 is a sectional view showing a developing unit of a conventional image forming apparatus.
Figure 2:
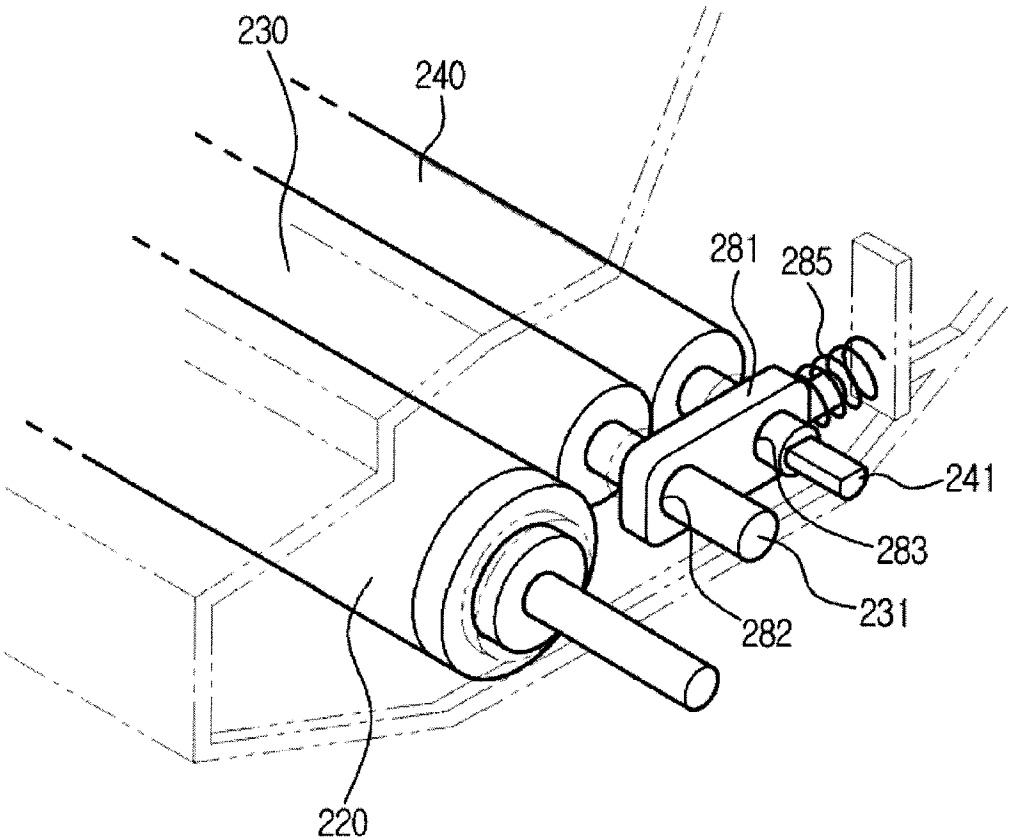
FIG. 2 is a perspective view showing the relevant portions of the developing unit of the conventional image forming apparatus depicted in FIG. 1.

Reference will now be made in detail to exemplary embodiments of the present invention, examples of which are illustrated in the accompanying drawings, wherein like reference numerals refer to like elements throughout. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be also noted that in the drawings, the dimensions of the features are not intended to be to true scale, and may be exaggerated for the sake of allowing greater understanding.

Figure 3:
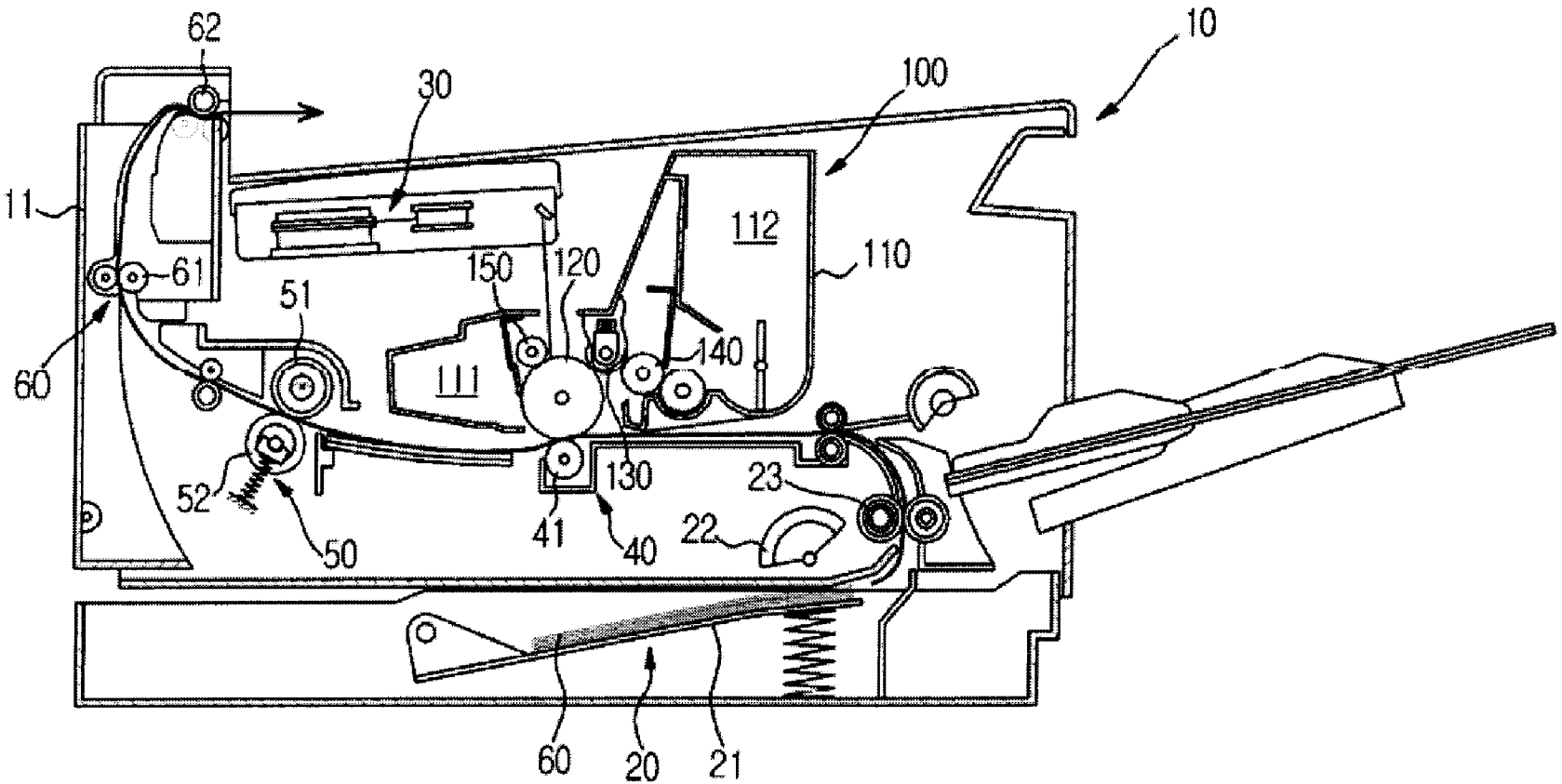
FIG. 3 is a sectional view showing an image forming apparatus according to an embodiment of the invention.

As shown in FIG. 3, an image forming apparatus according to an embodiment may include a main body 10, which forms an exterior appearance, and which may support various internally mounted components. The internally mounted components within the main body 10 may vary, but for illustration of an embodiment of the invention, may include, e.g., a paper feeding unit 20, a laser scanning unit 30, a developing unit 100, a transfer unit 40, a fusing unit 50 and a paper discharge unit.

A cover 11 may be coupled to the main body 10. The cover 11 may allow user access to the interior of the main body 10, so the user may inspect the interior of the main body 10 or replace internal components such as, e.g., the developing unit 100.

The paper feeding unit 20 may feed a printing medium, e.g., a sheet of paper S, toward the transfer unit 40. The paper feeding unit 20 may include a paper feeding tray 21 for supporting the paper S thereon, a pickup roller 22 to pick up the paper S loaded on the paper feeding tray 21, and a feeding roller 23 to feed the picked-up paper toward the transfer unit 40.

The developing unit 100 may supply developer, e.g., toner, to the photosensitive body 120 to develop an electrostatic latent image formed on the photosensitive body 120 into a visible image. The developing unit 100 may be provided in a cartridge form and may be removably mounted in the main body 10. The developing unit 100 will be described in more detail later.

The transfer unit 40 may include a transfer roller 41 supported in the main body 10 to oppose the photosensitive body 120. The transfer roller 41 acts to press the paper toward the photosensitive body 120 so that the visible image formed on the surface of the photosensitive body 120 may be transferred onto the paper.

The fusing unit 50 may include a heating roller 51 including a heat source, and a press roller 52 which may be pressed against the heating roller 51 with a predetermined pressure. When the paper passes between the heating roller 51 and the press roller 52, the visible image that had been transferred may be fused to the paper by the heat from the heating roller 51 and the pressure generated between the heating roller 51 and the press roller 52.

The paper discharge unit 60 may include discharge rollers 61 and 62, and may discharge the paper that had passed through the fusing unit 50 to the outside of the main body 10.

Figure 4:
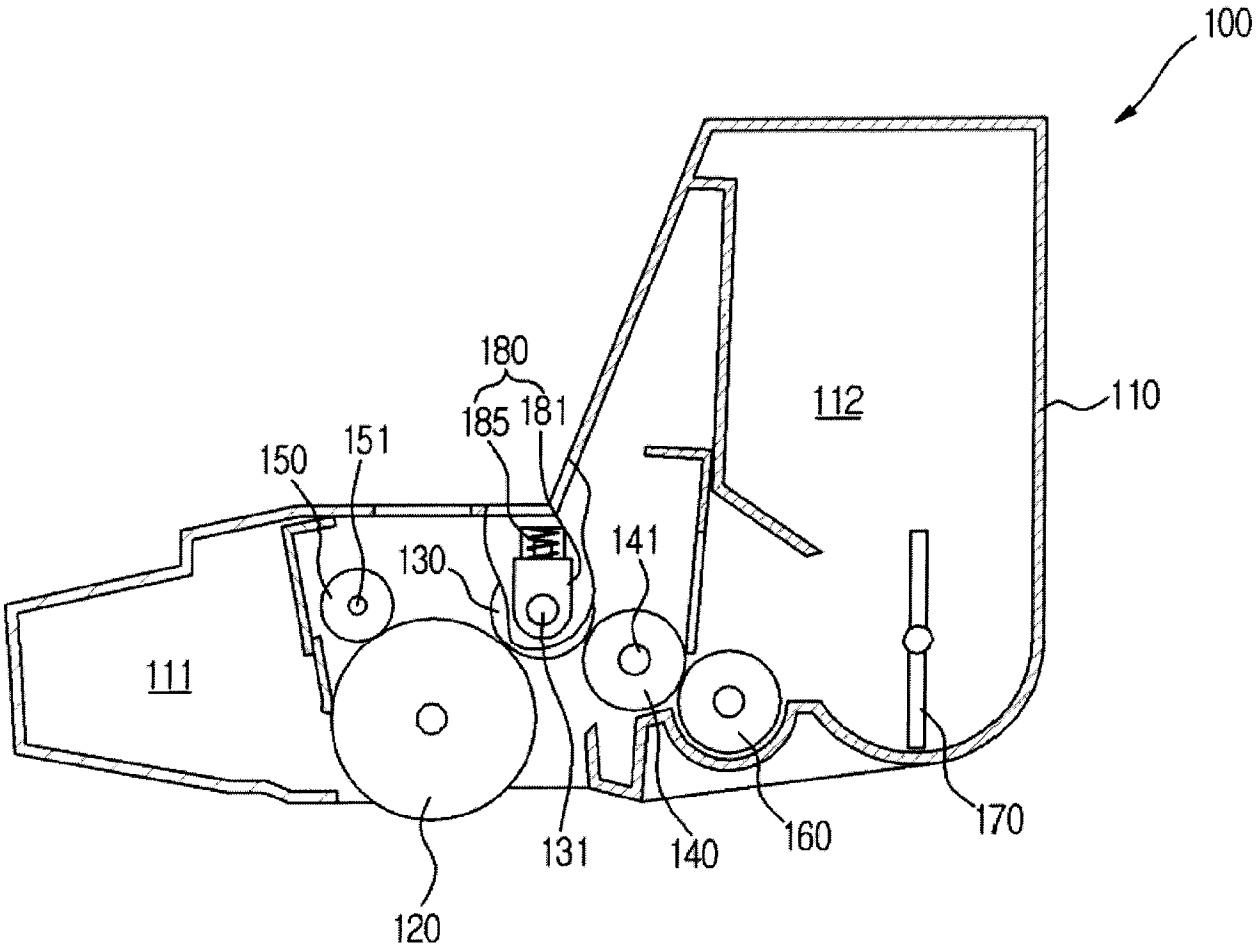
FIG. 4 is a sectional view showing a developing unit according to an embodiment of the invention usable in the image forming apparatus depicted in FIG. 3.

The developing unit of the image forming apparatus according to an embodiment of the invention is shown in FIG. 4. The developing unit 100 may include a developing unit housing 110, which defines an exterior appearance of the developing unit 100. The developing unit housing 110 may be divided into a component mounting part 111 and a developer storage part 112. The component mounting part may house therein a photosensitive body 120, a donor roller 130, a magnetic roller 140 and a charging roller 150. The developer storage part 112 may contain a supply of developer.

The arrangement of the developer storage part may vary, but as an illustration, may include a supply roller 160 and an agitator 170 supported therein. The supply roller 160 may be rotatably mounted near the magnetic roller 140 so that it may supply the developer stored in the developer storage part 112 to the magnetic roller 140. The agitator 170 may agitate the developer to prevent solidification of the developer.

The photosensitive body 120 may be rotatably mounted in the component mounting part 111 such that a portion of the surface of the photosensitive body 120 is exposed to the outside of the developing unit housing 110. The outer surface of the photosensitive body 120 may be coated, by deposition or the like, with a photoconductive material layer, and may be charged to a predetermined electric potential by the charging roller 150. A light beam from the laser scanning unit 30 may be irradiated to the charged surface of the photosensitive body 120, generating an electric potential difference, and thereby forming an electrostatic latent image.

Figure 5:
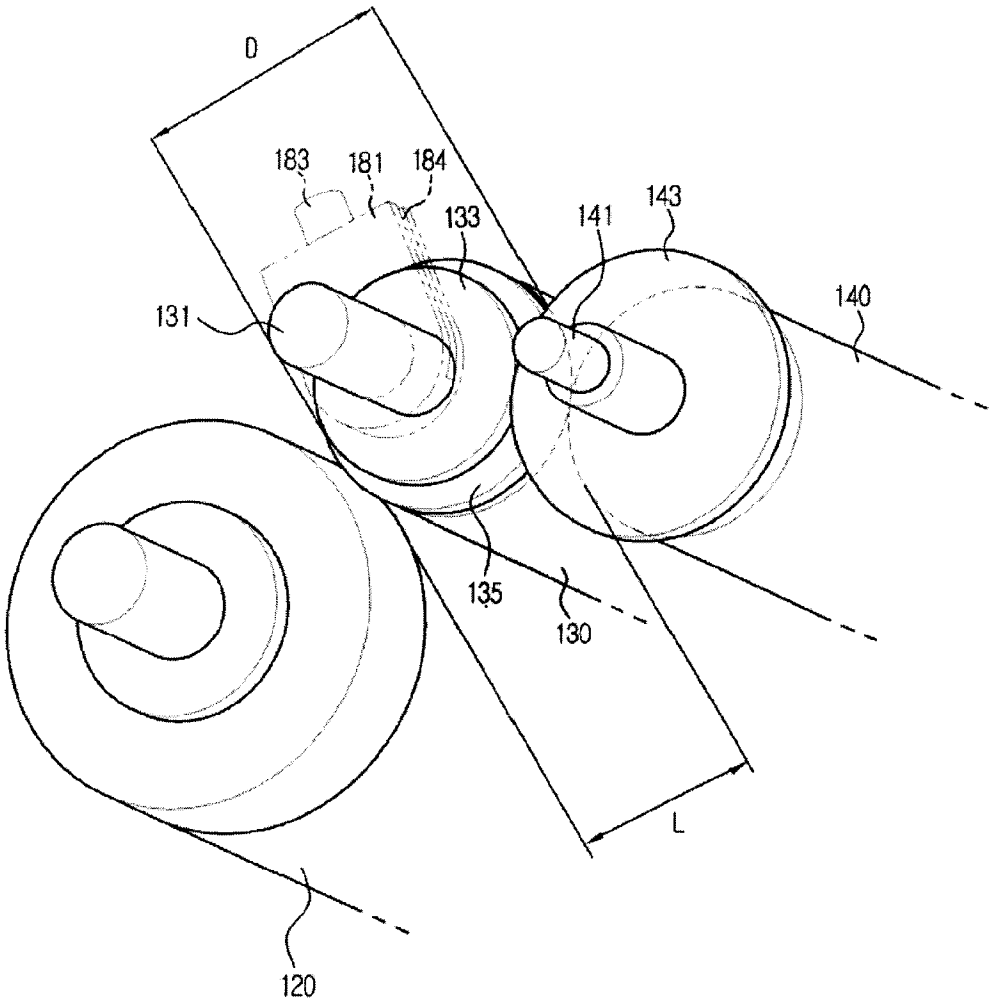
FIG. 5 is a perspective view showing a relevant portions of the developing unit depicted in FIG. 4.
Figure 6:
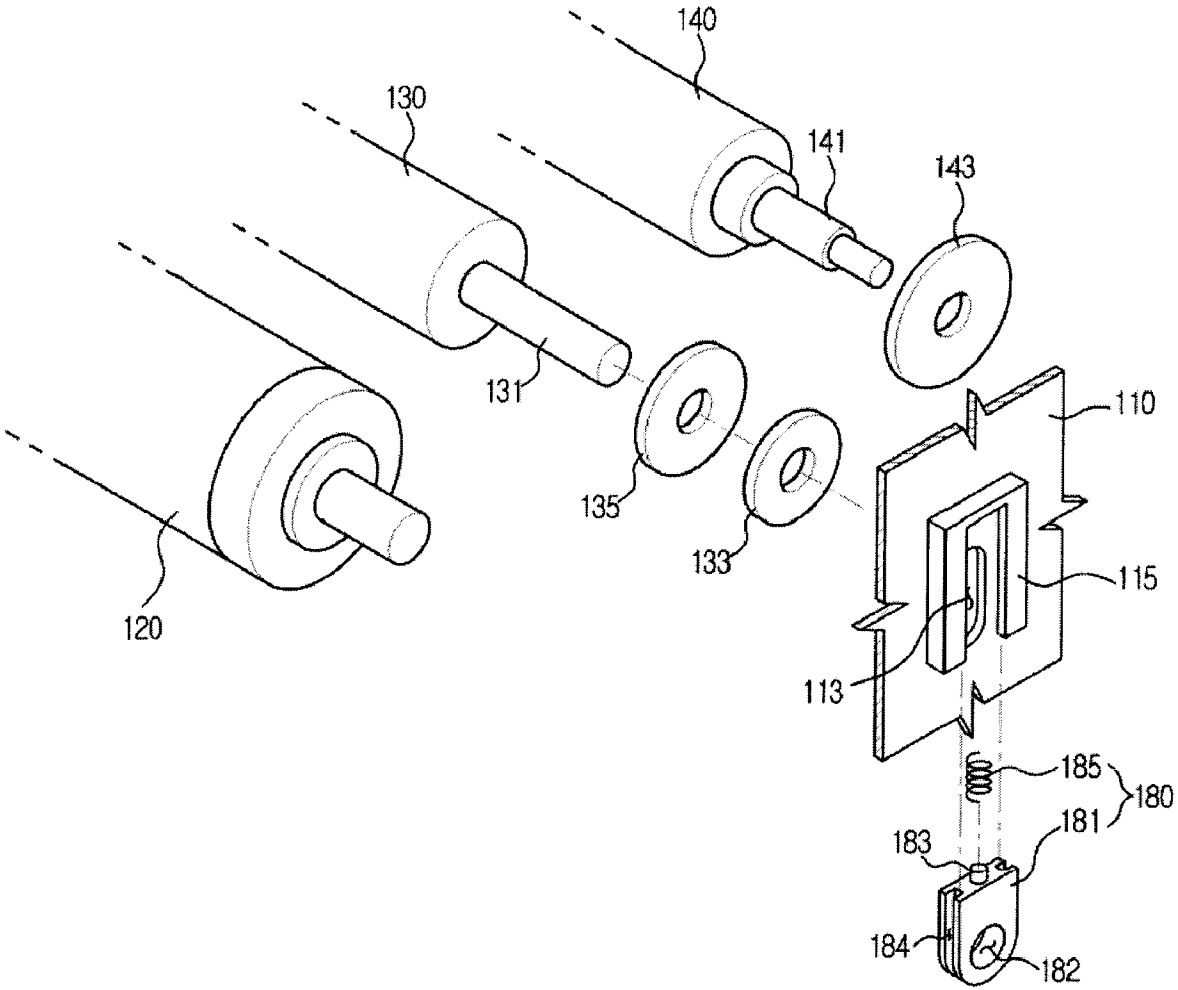
FIG. 6 is an exploded perspective view showing the portions of the developing unit depicted in FIG. 5.
Figure 7:
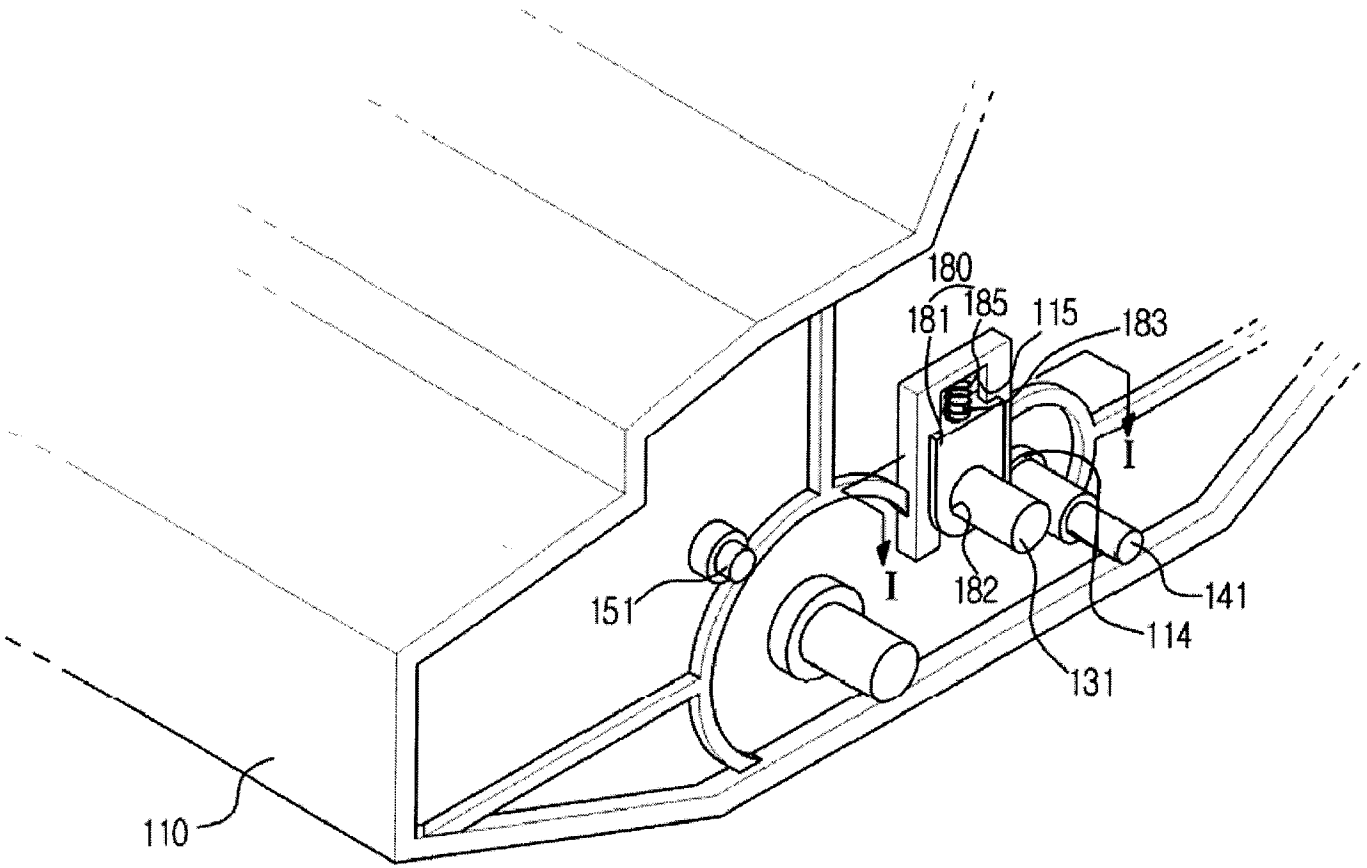
FIG. 7 is a view showing a coupling structure of the developing unit depicted in FIG. 6 and a developing unit housing according to an embodiment of the invention.
Figure 8:
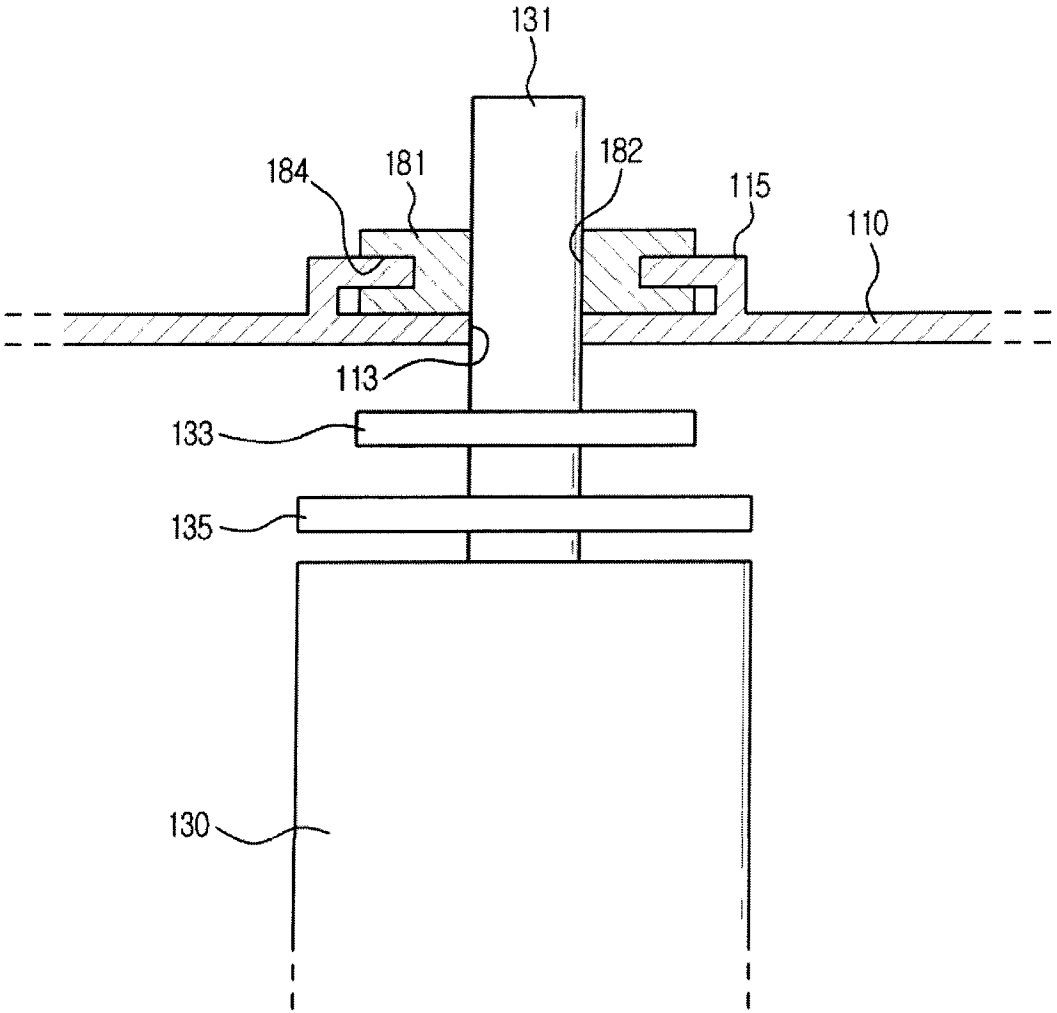
FIG. 8 is a sectional view taken along line I-I in FIG. 7.

As shown in FIGS. 5 to 7, in one embodiment of the invention, the magnetic roller 140 may be disposed at a predetermined distance from the photosensitive body 120. The magnetic roller 140 may receive the developer stored in the developer storage part 112 and supply the developer to the donor roller 130. As shown, the magnetic roller 140 may be rotatably supported in the developing unit housing 110, in particular, in the component mounting part 111, to rotate about a rotating shaft 141. The rotating shaft 141 may be fitted through a shaft hole 114 formed on the developing unit housing 110. A third gap ring 143 may be disposed on the rotating shaft 141 to maintain a preset gap between the magnetic roller 140 and the donor roller 130.

The donor roller 130 serves to supply the developer transmitted from the magnetic roller 140 to an electrostatic latent image formed on the photosensitive body 120, thereby developing the electrostatic latent image into a visible image. As shown in FIGS. 5 to 8, the donor roller 130 may be rotatably supported in the component mounting part 111 between the photosensitive body 120 and the magnetic roller 140 to rotate about a rotating shaft 131.

The rotating shaft 131 may be fitted through a shaft hole 113 formed on the developing unit housing 110. A first gap ring 133 may be disposed on the rotating shaft 131 of the donor roller 130. The first gap ring 133 may contact the third gap ring 143 to maintain the preset gap between the donor roller 130 and the magnetic roller 140. Alternatively, the first gap ring 133 may contact the magnetic roller 140 or the rotating shaft 141 to maintain the preset gap between the donor roller 130 and the magnetic roller 140. A second gap ring 135 may be disposed on the rotating shaft 131 of the donor roller 130. The second gap ring 135 may contact the photosensitive body 120 to maintain a preset gap between the donor roller 130 and the photosensitive body 120. The first gap ring 133 and the second gap ring 135 may be sequentially disposed on the rotating shaft 131 of the donor roller 130, and may differ in diameter in order to prevent the first gap ring 133 from interfering with the second gap ring 135. The first gap ring 133 may be disposed in parallel with the third gap ring 143 to allow contact with the third gap ring 143.

As shown in FIG. 4, according to an embodiment, the charging roller 150 may charge the outer surface of the photosensitive body 120 to a uniform electric potential. The charging roller 150 may be provided with a rotating shaft 151, with which it may be rotatably mounted in the developing unit housing 110.

As shown in FIGS. 5 to 8, according to an embodiment, a pressing unit 180 may be provide to maintain contact between the first gap ring 133 and the third gap ring 143, and to maintain contact between the second gap ring 135 and the photosensitive body 120.

The pressing unit 180 may include a holding member 181 to hold the donor roller 130, and an elastic member 185 to elastically support the holding member 181, and to elastically bias the donor roller 130 towards the photosensitive body 120 and the magnetic roller 140. The holding member 181 may include a through-hole 182 through which the rotating shaft 131 of the donor roller may be fitted. One end of the holding member 181 may have a supporting protrusion 183 to support an end of the elastic member 185. The holding member 181 may have a coupling groove 184, and the developing unit housing 110 may have a coupling rib 115 which fits into the coupling groove 184. The elastic member 185 may allow the holding member 181 to slide with the sliding contact between the coupling groove 184 and the coupling rib 115.

The holding member 181 may be slidably mounted to the outer surface of the developing unit housing 110 by the elastic member 185. The holding member 181 may alternatively be slidably mounted on the inner surface of the developing unit housing 110 by the elastic member 185. The shaft hole 113 through which the rotating shaft 131 of the donor roller 130 is fitted may be formed in a slot shape which extends in the elasticity direction of the elastic member 185. The rotating shaft 131 fitted through the holding member 181 may move with the holding member 181 when the holding member 181 slides by the elastic member 185.

The coupling groove 184 of the holding member 181 and the coupling rib 115 of the developing unit housing 110 may extend in the elasticity direction of the elastic member 185. While this embodiment is shown with a configuration, in which the holding member 181 is formed with the coupling groove 184 and the developing unit housing 110 is provided with the coupling rib 115, the coupling rib 115 may alternatively be provided in the holding member 181, in which case the coupling groove 184 may be provided on the developing unit housing 110.

In order to maintain the gap between the donor roller 130 and the photosensitive body 120 or the gap between the donor roller 130 and the magnetic roller 140 to a gap preset by the pressing unit 180, according to a preferred aspect of the present invention, as shown in FIG. 5, the diameter D of the donor roller 130 disposed between the photosensitive body 120 and the magnetic roller 140 is arranged to be larger than the closest surface distance L between the photosensitive body 120 and the magnetic roller 140.

The first gap ring 133 and the second gap ring 135, which are placed on the rotating shaft 131 of the donor roller, have different diameters, so as to be contacted to the third gap ring 143 and the photosensitive body 120, respectively, without interfering with each other. Because the donor roller 130 has the diameter D larger than the distance L between the photosensitive body 120 and the magnetic roller 140, the central axis of the donor roller 130 may be positioned above or below the central axis of the photosensitive body 120 and the central axis of the magnetic roller 140.

That is, according to a preferred embodiment, with the diameter D of the donor roller 130 being larger than the distance L between the photosensitive body 120 and the magnetic roller 140, the contacts between the first gap ring 133 and the third gap ring 143, and between the second gap ring 135 and the photosensitive body 120 may maintained without interfering each other with the simpler arrangement of the holding member 181 of the pressing unit 180 elastically biased by the elastic member 185 to press only the donor roller 130 toward the magnetic roller 140 and the photosensitive body 120.

Although embodiments of the present invention have been shown and described, those skilled in the art can appreciate that changes may be made to these embodiments without departing from the principles and spirit of the invention, the scope of which is defined in the claims and their equivalents.

What is claimed is:

1. An image forming apparatus, comprising:

a photosensitive body;

a magnetic roller disposed to be spaced apart from the photosensitive body at their closest points by a distance;

a donor roller disposed adjacent the photosensitive body and the magnetic roller, the donor roller having a diameter larger than the distance between the magnetic roller and the photosensitive body; and a pressing unit configured to maintain a first gap between the donor roller and the photosensitive body and a second gap between the donor roller and the magnetic roller to a preset gap.

2. The image forming apparatus according to claim 1, wherein the pressing unit surrounds the shaft of the donor roller.

3. The image forming apparatus according to claim 1, wherein the donor roller comprises a first gap ring and a second gap ring, and wherein, when the pressing unit presses at least one of the photosensitive body the magnetic roller and the donor roller toward one another, the first gap ring contacts a portion of the magnetic roller, and the second gap ring contacts a portion of the photosensitive body.

4. The image forming apparatus according to claim 3, wherein the magnetic roller includes a magnetic roller rotating shaft, about which the magnetic roller rotates, the donor roller including a donor roller rotating shaft, about which the donor roller rotates, each of the first gap ring and the second gap ring being disposed on the donor roller rotating shaft.

5. The image forming apparatus according to claim 4, wherein the first gap ring has a first diameter different from a second diameter of the second gap ring.

6. The image forming apparatus according to claim 5, wherein the magnetic roller comprises a third gap ring disposed on the magnetic roller rotating shaft, the first gap ring being in contact with the third gap ring when the pressing unit presses at least one of the photosensitive body the magnetic roller and the donor roller toward one another.

7. The image forming apparatus according to claim 6, wherein the first gap ring and the third gap ring are arranged parallel to each other.

8. The image forming apparatus according to claim 4, wherein the pressing unit comprises:

a holding member configured to support the donor roller; and an elastic member configured to elastically bias the holding member such that the donor roller supported by the holding member is biased to move in a direction toward at least one of the photosensitive body and the magnetic roller.

9. The image forming apparatus according to claim 8, wherein the holding member comprises a through-hole, through which the donor roller rotating shaft is fitted.

10. The image forming apparatus according to claim 9, further comprising:

a developing unit housing, in which each of the photosensitive body, the magnetic roller and the donor roller is rotatably supported, wherein the holding member comprises a coupling groove, and the developing unit housing comprises a coupling rib in sliding contact with the coupling groove so as to allow a sliding movement of the holding member.

11. A developing device usable in an image forming apparatus, comprising:

a first rotating body configured to rotate about a first rotational shaft;

a second rotating body configured to rotate about a second rotational shaft;

a first gap ring disposed on the first rotational shaft, the first gap ring being configured to interfere with a movement of the second rotating body toward the first rotating body;

a pressing device configured to push the first rotating body toward the second rotating body so as to maintain a first gap between the first rotating body and the second rotating body;

a third rotating body configured to rotate about a third rotational shaft; and a second gap ring disposed on the first rotational shaft, the second gap ring being configured to interfere with a movement of the third rotating body toward the first rotating body.

12. The developing device according to claim 11, wherein the pressing device is further configured to push the first rotating body toward the third rotating body so as to maintain a second gap between the first rotating body and the third rotating body.

13. The developing device according to claim 12, wherein the second rotating body and the third rotating body being spaced apart at their closest points by a distance, the first rotating body having a diameter larger than the distance, wherein the second and third rotational shafts each being arranged on a first common plane that does not contain the first rotational shaft.

14. The developing device according to claim 12, further comprising:

a third gap ring disposed on the second rotational shaft, the third gap ring being configured to contact the first gap ring.

15. The developing device according to claim 14, wherein the first gap ring and the second gap ring have different diameters.

16. The developing device according to claim 14, further comprising:

a developing unit housing, in which each of the first, second and third rotational bodies is rotatably supported, wherein the pressing unit comprises:

a holding member configured to support the first rotating body; and an elastic member configured to elastically bias the holding member such that the first rotating body supported by the holding member is biased to move in a direction toward the second and third rotating bodies.

17. The developing device according to claim 16, wherein the holding member comprises a through-hole, in which the first rotational shaft is supported.

18. The developing device according to claim 16, wherein the holding member comprises a coupling groove, and the developing unit housing comprises a coupling rib in sliding contact with the coupling groove so as to allow a sliding movement of the holding member.

19. A developing device usable in an image forming apparatus, comprising:

a photosensitive body configured rotate about a first rotational shaft;

a magnetic roller configured to rotate about a second rotational shaft, the magnetic roller being spaced apart from the photosensitive body at their closest points by a distance;

a donor roller configured rotate about a third rotational shaft, the donor roller being disposed adjacent the photosensitive body and the magnetic roller, the donor roller having a diameter larger than the distance between the magnetic roller and the photosensitive body;

a first gap ring disposed on the third rotational shaft, the first gap ring being configured to interfere with a movement of the photosensitive body toward the donor roller;

a second gap ring disposed on the third rotational shaft, the second gap ring being configured to interfere with a movement of the magnetic roller toward the donor roller and a pressing device configured to elastically bias the donor roller toward the photosensitive body and the magnetic roller so as to maintain a first gap between the photosensitive body and the donor roller and a second gap between the magnetic roller and the donor roller.

20. The developing device according to claim 19, further comprising:

a third gap ring disposed on the second rotational shaft, the third gap ring being configured to contact the first gap ring, the first gap ring having a diameter different from a second diameter of the second gap ring.

21. The developing device according to claim 20, further comprising:

a housing, in which each of the magnetic roller and the donor roller is rotatably supported, wherein the pressing unit comprises:

a holding member including a through-hole in which the third rotational shaft is rotatably supported; and an elastic member coupled to the housing, the elastic member being configured to elastically bias the holding member such that the donor roller supported by the holding member is biased to move in a direction toward the photosensitive body and the magnetic roller.

22. The developing device according to claim 21, wherein the holding member comprises a coupling groove, and the housing comprises a coupling rib in sliding contact with the coupling groove so as to allow a sliding movement of the holding member.

23. The developing device according to claim 21, wherein the holding member comprises a coupling rib, and the housing comprises a coupling groove in sliding contact with the coupling rib so as to allow a sliding movement of the holding member.

24. The developing device according to claim 21, further comprising:

a slot formed on the housing, the third rotational shaft being received into the slot.

25. An image forming apparatus, comprising: a photosensitive body;

a magnetic roller disposed to be spaced apart from the photosensitive body at their closest points by a distance;

a donor roller disposed adjacent the photosensitive body and the magnetic roller, the donor roller having a diameter larger than the distance between the magnetic roller and the photosensitive body;

a first gap ring and a second gap ring disposed about a shaft of the donor roller, and a pressing unit to press at least one of the photosensitive body, the magnetic roller and the donor roller toward one another, the first gap ring contacting a portion of the magnetic roller, and the second gap ring contacting a portion of the photosensitive body.

26. The image forming apparatus according to claim 25, wherein the pressing unit surrounds the shaft of the donor roller.

* * * * *